US008649966B2

(12) United States Patent
Kamata et al.

(10) Patent No.: US 8,649,966 B2
(45) Date of Patent: Feb. 11, 2014

(54) DRIVE SUPPORT SYSTEM

(75) Inventors: Yutaka Kamata, Wako (JP); Kazumitsu Kushida, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 217 days.

(21) Appl. No.: 13/240,526

(22) Filed: Sep. 22, 2011

(65) Prior Publication Data

US 2012/0083999 A1 Apr. 5, 2012

(30) Foreign Application Priority Data

Sep. 30, 2010 (JP) ..... 2010-222817

(51) Int. Cl.
*G08G 1/16* (2006.01)
*G08G 1/133* (2006.01)
*G08G 1/137* (2006.01)

(52) U.S. Cl.
USPC ..... 701/301; 701/409

(58) Field of Classification Search
None
See application file for complete search history.

(56) References Cited

U.S. PATENT DOCUMENTS 5,367,463 A * 11/1994 Tsuji ..... 701/409
5,488,559 A * 1/1996 Seymour ..... 701/446
7,057,499 B2 * 6/2006 Kanemitsu ..... 340/435
7,339,496 B2 * 3/2008 Endo et al. ..... 340/995.12
7,426,437 B2 * 9/2008 Breed et al. ..... 701/301
2009/0187343 A1 * 7/2009 Koch-Groeber et al. ..... 701/301
2010/0039318 A1 * 2/2010 Kmiecik et al. ..... 342/357.07
2012/0209519 A1 * 8/2012 Basnayake ..... 701/457

FOREIGN PATENT DOCUMENTS

JP 2002-316601 * 10/2002
JP 2002-342899 * 11/2002
JP 2005-352610 12/2005

* cited by examiner

*Primary Examiner* — Michael J Zanelli
(74) *Attorney, Agent, or Firm* — Squire Sanders (US) LLP

(57) ABSTRACT

A drive support system can provide drive support information on traveling of an own vehicle with respect to another vehicle based on positional information. The drive support system can include a drive support level determination part which changes the degree of offer of the drive support information in a stepwise manner corresponding to a traveling area of the own vehicle. An error occurrence area memory part stores an area where an error in the positional information meets or exceeds a predetermined level in advance along with map information. A degree of offer of the drive support information is limited when the own vehicle is present within an area where an error in the positional information meets or exceeds a predetermined level.

20 Claims, 10 Drawing Sheets

(a)

(b)

(c)

DRIVE SUPPORT SYSTEM

BACKGROUND

1. Field

The present invention relates to a drive support system which allows moving bodies such as vehicles to perform the transmission/reception of positional information therebetween and offers drive support information on traveling based on the positional information to the vehicles.

2. Description of the Related Art

Recently, there has been proposed a system which can confirm a position, a traveling direction and a speed of other vehicle (another vehicle) with respect to one's own vehicle (own vehicle) by exchanging information via inter-vehicle communication using a short-range radio.

This system displays information on a traveling state and a relative position of another vehicle which is present on the periphery of the own vehicle, image information, a road condition, a sign and the like on an alarm and display part by receiving operational information on manipulation switches such as blinkers, information on another vehicle on a vehicle traveling state such as positional information, a speed, a yaw rate and lateral acceleration via the inter-vehicle communication with, for example, another vehicle.

In such a system, it is necessary for the system to grasp accurate positional information on another vehicle on a map. Patent document 1 (Japanese Patent Publication JP-A-2005-352610) discloses a technique where map matching of a current position of another vehicle on a map is performed, and drive support information is notified based on the current position of another vehicle and a current position of the own vehicle in a map-matched state.

SUMMARY

When the presence or the non-presence of notification of drive support information is determined based on the information obtained by map matching as in a case of the above-mentioned system, it is desirable to perform highly accurate map matching for preventing erroneous notification.

However, the highly accurate map matching is liable to be expensive. Also, depending on the accuracy of map matching, there may be a case where a road on a map does not always agree with a road on which a vehicle actually travels. Accordingly, when drive support information is notified in a form that the drive support information includes such a phenomenon, there is a possibility that the drive support information is not properly notified or communicated when necessary.

The present invention has been proposed in view of such circumstances, and it is an object of the present invention to provide, in a drive support system which offers drive support information on traveling of an own vehicle with respect to another vehicle based on positional information on vehicles via inter-vehicle communication, a system which can properly offer drive support information.

To achieve the above-mentioned object, in one embodiment a drive support system offers drive support information on traveling relating to the degree of danger of an own vehicle with respect to another vehicle based on positional information. This is performed by carrying out transmission and reception of at least positional information between the own vehicle and another vehicle when another vehicle is present within a communication area of the own vehicle. The drive support system can include a drive support level determination part which elevates the degree of offer of the drive support information relating to the degree of danger in a stepwise manner as the own vehicle and another vehicle approach to each other in positional relationship. An error occurrence area memory part can store an area where an error in the positional information becomes a predetermined level or more in advance along with map information.

Further, when the own vehicle is present within the area where the error in the positional information becomes the predetermined level or more, the drive support information whose degree of offer of the drive support information relating to the degree of danger becomes a predetermined value or more is limited.

In another embodiment, the drive support system is such that the degree of offer of the drive support information determined by the drive support level determination part can include (A) a stage where the drive support system informs the presence another vehicle within the communication area, and (B) a stage where the drive support system informs a direction along which another vehicle having a near positional relationship with the own vehicle is present, and the offer of the drive support information at the stage (B) is inhibited when the own vehicle is present in the area where the error of the positional information is at the predetermined level or more.

In another embodiment, the drive support system is such that the drive support level determination part includes an error level determination part which determines whether or not an error of the positional information is at a predetermined level or more. When the determination area where the error level determination part determines that the error is at the predetermined level or more is an area which is not stored in the error occurrence area memory part, the determination area can be newly stored in the error occurrence area memory part.

In another embodiment, the drive support system is such that the error level determination part stores positional information acquired at predetermined intervals and calculates an approximate straight line based on the stored positional information, and the determination of the error in the positional information is performed under a condition where the positional information is away from the approximate straight line by a predetermined distance or more.

In another embodiment, the drive support system is such that the map information includes nodes which are in conformity with a shape of a road and a straight line link which connects the nodes. The error level determination part can determine an error level when the degree of parallelization between the straight line link and the approximate straight line is within a predetermined value.

In another embodiment, the drive support system is such that the drive support system includes an output means which outputs the drive support information. When the own vehicle is present within the area where the error in the positional information is at a predetermined level or more, information indicative of the presence of the own vehicle in the area is output to the output means.

In another embodiment, the drive support system is such that the output means is a display means capable of displaying map information. The error occurrence area memory part can reflect an area where an error is at a predetermined level or more on the map information as a visual image, and can increase an area of the visual image along with the increase of the error.

In yet another embodiment, the drive support system is such that a length of the area of the visual image in a widthwise direction is a length obtained by adding a width of a road to a size of the error.

In a further embodiment, the drive support system is such that the error occurrence area memory part can be subjected to a centralized control by a control center, and the error occurrence area memory part can collect, update and distribute error information from the own vehicle and another vehicle.

In another embodiment the drive support system is such that the own vehicle can include a yaw rate gyro sensor, and when a trajectory of the own vehicle can be changed within the approximate straight line, a new approximate straight line is formed by adding a change amount of a yaw angle obtained by integrating a value of the yaw rate gyro sensor to an approximate straight line calculated by the error level determination part. The determination of an error in the positional information is performed based on the new approximate straight line.

In certain of the embodiments, when the own vehicle is present in the area where the error in the positional information on the own vehicle or another vehicle is large (poor accuracy), the degree of offer of the drive support information can be limited and hence, even when the map matching is not performed, the degree of offer of the drive support information corresponding to the error in the positional information can be properly set.

Further, even when the own vehicle is present in the area where the error in the positional information is large, the drive support information can be continuously offered to the own vehicle in a state where the degree of offer of the drive support information is set less than the predetermined value. Therefore, it is possible to make the driver of the own vehicle conscious of the presence of another vehicle.

According to some embodiments, the offer of the information which has a possibility of directly influencing a traveling state of the own vehicle by the drive support information can be prevented. Therefore, when the own vehicle is present in the area where the error is large, it is possible to prevent the driver of the own vehicle from erroneously recognizing the drive support information due to the offer of information with poor accuracy.

According to some embodiments, by updating the area with the large error in the error occurrence area memory part from time to time, the accuracy of the error information stored in the error occurrence area memory part (16, 92) can be enhanced.

According to some embodiments, the positional information can be updated in the error occurrence area memory part by readily performing the determination of the error level based on the actually acquired positional information. Therefore, the error occurrence area memory part can be readily updated.

According to some embodiments, the error level can be determined based on the approximate straight line which omits the positional information with large error (low positional accuracy). Therefore, the determination of the error level can be performed with higher accuracy.

According to some embodiments, the driver of the own vehicle himself can recognize that the own vehicle is present in the area with the large error. Therefore, the driver himself can also easily determine the reliability of the offered drive support information. In certain embodiments, a driver can easily recognize the error level.

According to certain embodiments, the drive support system can display the error area including the road width irrespective of the road width.

According to certain embodiments, the error information stored in the error occurrence area memory parts can by shared by the own vehicle and another vehicle in common and hence, the accuracy of the error information can be further enhanced.

According to other embodiments, the accuracy of the determination of the error can be enhanced with respect to a drawback peculiar to a two-wheeled vehicle that the advancing direction is liable to be changed in bank traveling or the like.

DETAILED DESCRIPTION

One example of an embodiment of a drive support system according to the present invention is explained in conjunction with drawings. The drive support system according to the present invention provides drive support information when a driver drives his own vehicle, wherein when another vehicle is within a communication area of the own vehicle or when a distance between the own vehicle and another vehicle (including a four-wheeled vehicle) is not more than a predetermined distance, the drive support system confirms a position, a traveling direction and a speed of another vehicle with respect to the own vehicle by exchanging information via inter-vehicle communication using a short-range radio.

Hereinafter, the drive support system when the own vehicle is a two-wheeled vehicle is explained.

Figure 1:
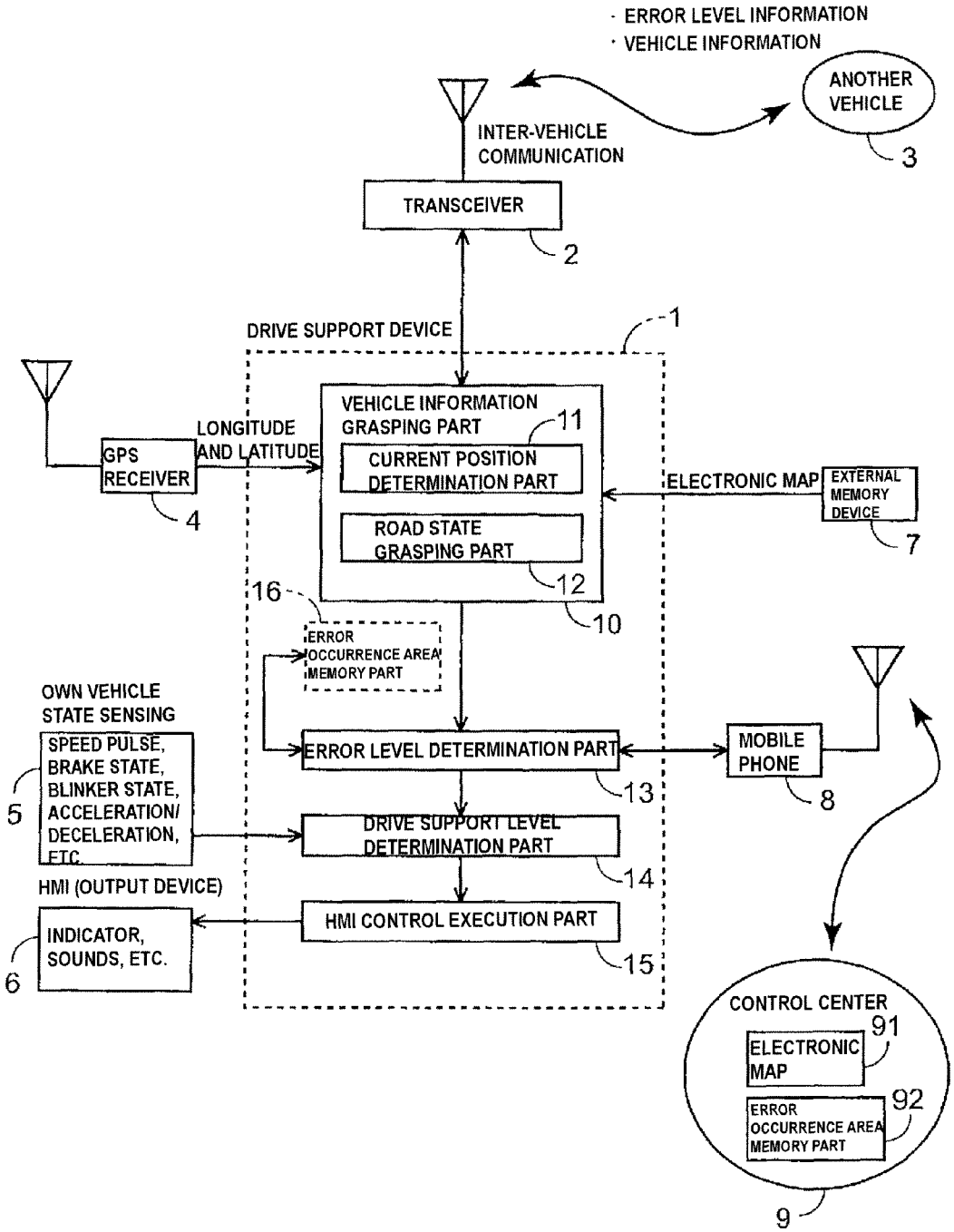
FIG. 1: A block diagram showing one example of an embodiment of a drive support system according to the present invention.

In the drive support system as shown in FIG. 1, for example, a drive support device 1, a transceiver 2, a GPS receiver 4, various types of sensors 5, an output device 6 which outputs drive support information, an external memory device 7 in which an electronic map is stored, a mobile phone 8 for communication with a control center 9 which controls information on drive support are mounted on the own vehicle. The drive support system can acquire another vehicle information from another vehicle 3, longitude and latitude information on the own vehicle from the GPS receiver 4 and traveling information on the own vehicle from the various types of sensors 5 respectively, and offers the drive support information to the output device 6 based on these information.

The transceiver 2 can acquire another vehicle information from another vehicle 3 traveling within a communication range which is a fixed range about the own vehicle via the inter-vehicle communication, and the inter-vehicle communication is performed at a communication speed of 10 Hz (transmission of 10 times per second), for example. The communication speed of the inter-vehicle communication may be changed corresponding to a vehicle speed. As another vehicle information, the driver can acquire information on a type of vehicle (two-wheeled vehicle, ordinary four-wheeled vehicle, large-size four-wheeled vehicle or the like), a position, a speed and a direction of the vehicle, for example.

Further, the transceiver 2 acquires traffic jam information by receiving passing of vehicles through places where a light beacon, an ETC or the like is installed via road-vehicle communication.

The GPS receiver 4 receives longitude and latitude information on the own vehicle.

Various types of sensors 5 are various types of sensors such as a vehicle speed sensor which detects a vehicle speed and a gyro sensor, and detect a vehicle speed, acceleration, a direction, an inclination (when the own vehicle is a two-wheeled vehicle), a brake state, a blinker state and the like of the own vehicle.

The output device 6 is constituted of a speaker for outputting voices which is mounted on the own vehicle (vehicle), indicators which are arranged in the inside of a meter mounted on a front side of a handle bar or are mounted on an inner lower portion of a front screen, a vibrator which is mounted in the vicinity of a seat or the like. The output device 6 allows the driver (rider) to recognize another vehicle information offered by the drive support device 1 visually, by sounds or the like.

Electronic map information can be stored in the external memory device 7 in advance.

The control center 9 performs a collective control of the whole vehicle information during traveling, and includes an error occurrence area memory part 92 which stores areas where an error of positional information on a map is liable to occur as information relating to drive support. The error occurrence area memory part 92 stores areas where a level of error on positional information becomes a predetermined level or more in conformity with map information in advance.

Further, the control center 9 may include electronic map information 91. In this case, the control center 9 performs the centralized control of error information by collecting, updating and distributing error information from the own vehicle and another vehicle. Error information controlled by the control center 9 is offered to a drive support device 1 side via the communication between the control center 9 and the mobile phone 8.

The drive support device 1 includes a vehicle information grasping part 10 which grasps vehicle information on the own vehicle through inputting of information to the vehicle information grasping part 10 from the transceiver 2, the GPS receiver 4 and the sensor 5. The vehicle information grasping part 10 includes a current position determination part 11 and a road state grasping part 12, and acquires node link information from map database of the external memory device 7. The current position determination part 11 determines a current position of the own vehicle on the electronic map acquired from the external memory device 7 based on information acquired by the GPS receiver 4 thus grasping a current position of the own vehicle with respect to an intersection existing at the traveling destination of the own vehicle.

The road state grasping part 12 grasps a road state such as traffic jam information via road-vehicle communication by the transceiver 2.

Further, the drive support device 1 can include an error level determination part 13 which determines an error level of acquired information based on a trajectory of the own vehicle grasped by the current position determination part 11, a drive support level determination part 14 which changes the degree of offer of drive support information in a stepwise manner corresponding to a traveling area of the own vehicle, an HMI control execution part 15 which controls the offer of the drive support information to the output device 6, and an error occurrence area memory part 16 which stores areas where a level of error in positional information becomes a predetermined level or more in advance in conformity with the map information.

The detail of steps of determining the error level by the error level determination part 13 will be explained later.

A drive support level by the drive support level determination part 14 can be offered as information to the output device 6 via the HMI control execution part 15 corresponding to a distance between the own vehicle and another vehicle and speeds of the own vehicle and another vehicle. For example, the drive support level can be constituted of three stages which might include "offer of information", "invitation of attention" and "alarm", for example. The drive support level becomes "offer of information" when there is a sufficient distance between the own vehicle and another vehicle, becomes "invitation of attention" when both vehicles approach to each other so that the distance between the own vehicle and another vehicle is further shortened (for example, a limit position that the own vehicle or another vehicle can stop when braking is applied within a certain response time), and becomes "alarm" when there is no time before both vehicles collide (a position where the own vehicle or another vehicle cannot stop unless the instruction to apply braking is not issued).

"Offer of information" is a stage (A) where the drive support device 1 informs that another vehicle is present within a communication area. In this stage, the drive support device 1 does not make the determination and simply offers information (the information of a level that "another vehicle is present within a communication area"). To be more specific, lighting of an indicator or the like is performed by the output device 6. A vehicle which is equipped with a navigation system displays a position of another vehicle on a screen.

"Invitation of attention" is a stage (B) where the drive support device 1 informs that the direction along which another vehicle having a near positional relationship with the own vehicle is present. In this stage, although the drive support device 1 makes the determination, the drive support device 1 does not make an instruction. To be more specific, the drive support device 1 performs lighting of the indicator of the output device 6 to allow the driver to recognize the direction along which another vehicle is present. When the vehicle is equipped with the navigation system, the direction along which another vehicle advances is displayed on the screen.

"Alarm" is a stage (C) where the drive support device 1 instructs an action on the own vehicle. In this stage, the drive support device 1 makes the determination and instructs the driver to take an action (deceleration, for example) with sounds or the like by the output device 6. The offer of information may be made in two stages consisting of the stage (A) and the stage (B) by eliminating the stage (C).

Figure 2:
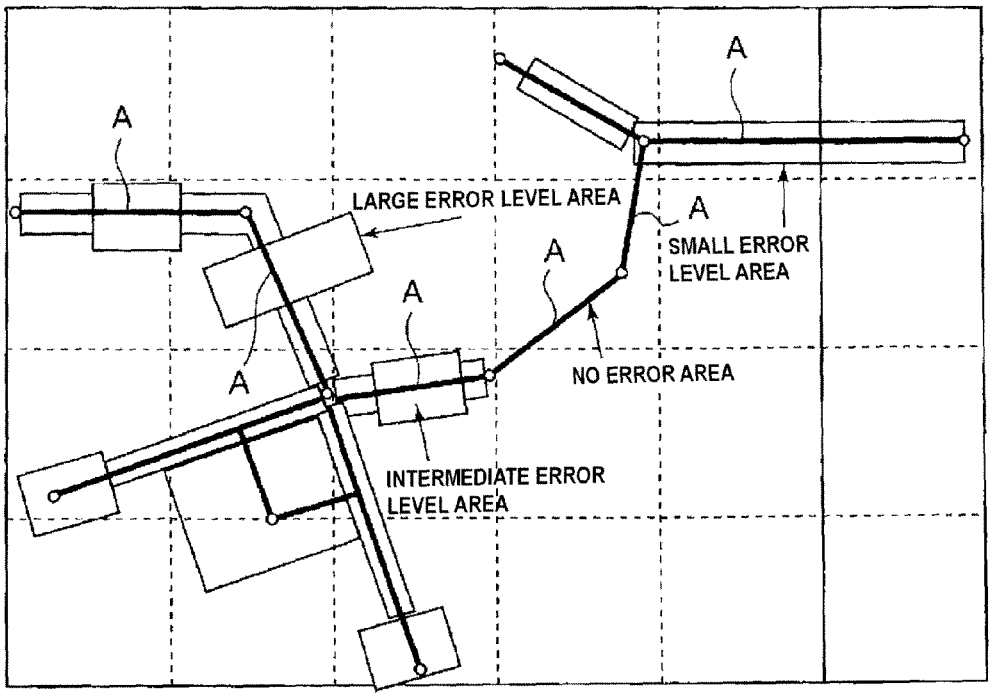
FIG. 2: A view showing one example of an error map which is stored in an error occurrence area memory part.

In the error occurrence area memory part 92, as shown in FIG. 2, an error map (error area map) where an area of, for example, several kilometers square is set as 1 area (mesh), and a plurality of areas are joined to each other is stored. In the map information of the respective areas, a large error level area, an intermediate error level area, a small error level area and no error area which differ from each other in length in the road widthwise direction with respect to a straight-line link A of each road are set respectively. With respect to the respective error areas, locations where these error areas set in advance are stored, and when a new error area is confirmed by the error level determination part 13, the location of the error level is stored and updated.

In the above-mentioned example, the error occurrence area memory part 92 is arranged on a control center 9 side, error information is offered to the error level determination part 13 via the communication between the control center 9 and the mobile phone 8 arranged on the own vehicle side, and error information in the error occurrence area memory part 92 is updated by transmitting new error information to the control center 9 side.

Further, in place of the error occurrence area memory part 92 on the control center 9 side, the error occurrence area memory part 16 may be arranged in the inside of the drive support device 1. In this case, when the error area is newly confirmed by the error level determination part 13, information is updated only by the error occurrence area memory part 16 in the inside of the drive support device 1 of the own vehicle.

In the drive support system according to the present invention, when the error level determination part 13 determines that the own vehicle is present in an area where an error of positional information offered from the error occurrence area memory part 92 or the error occurrence area memory part 16 is a predetermined level or more, the drive support information where the degree of offer of drive support information to the own vehicle is at a predetermined level or more is limited.

That is, in the drive support device 1, when it is determined that the own vehicle is present in the area where the error of positional information is a predetermined level (for example, intermediate error level) or more, the drive support device 1 inhibits the output device 6 to offer at least the drive support information at the stage (C) corresponding to "alarm" instructing the driver to take an action on the own vehicle. When the error levels are provided in two stages consisting of the stage (A) and the stage (B), the stage (B) is inhibited.

Next, steps of determining the error level by the error level determination part 13 is explained in conjunction with FIG. 3 to FIG. 6.

Figure 3:
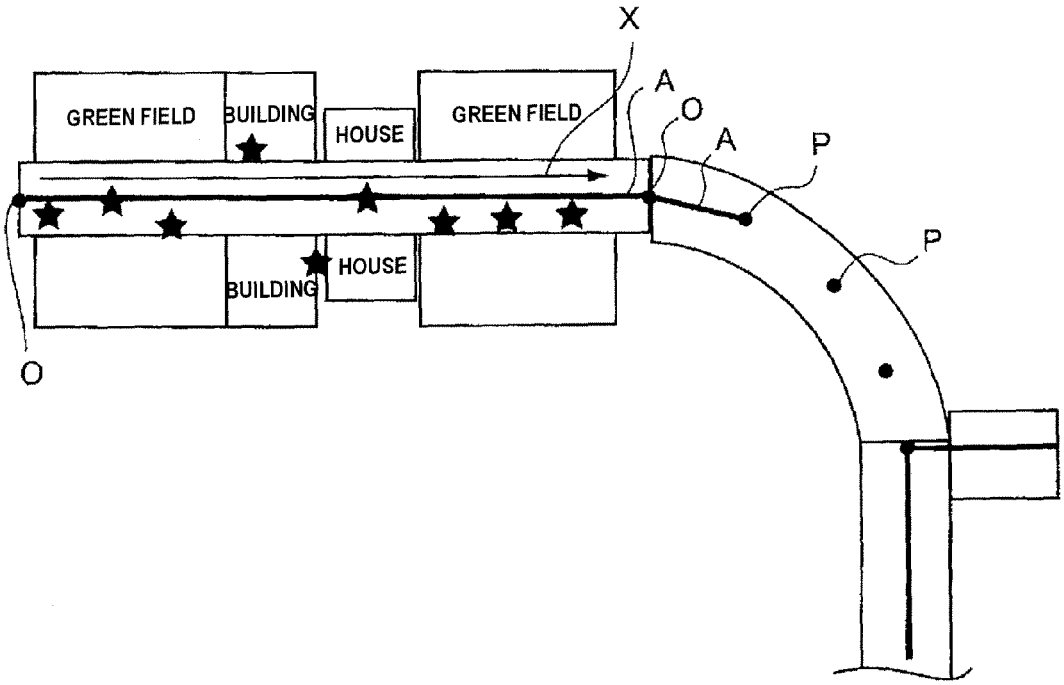
FIG. 3: A view showing one example of electronic map data.

The electronic map acquired from the map database of the external memory device 7 is, as shown in FIG. 3, provided with nodes (end points) which are present at both ends of a straight line road and auxiliary nodes (shape interpolating points) which are present at intervals at a center position of a curved road. In data on vehicle position acquired when a vehicle actually passes, an error occurs due to the difference in a reception state depending on a state where a high building is present on the periphery of a road or the like and hence, there may be a case where the vehicle position deviates from the straight-line link A which connects the nodes.

For example, in FIG. 3, assuming a traveling trajectory of a vehicle on the electronic map as X, data of the vehicle position acquired when the vehicle passes become positions plotted by star marks. In this manner, when the own vehicle is at a place which is shaded by a building, a house or the like so that the communication between the vehicle and a GPS satellite is difficult, an error is liable to occur. When the own vehicle is at a place where sufficient upward perspective is ensured such as a green field, the error becomes small.

Figure 4:
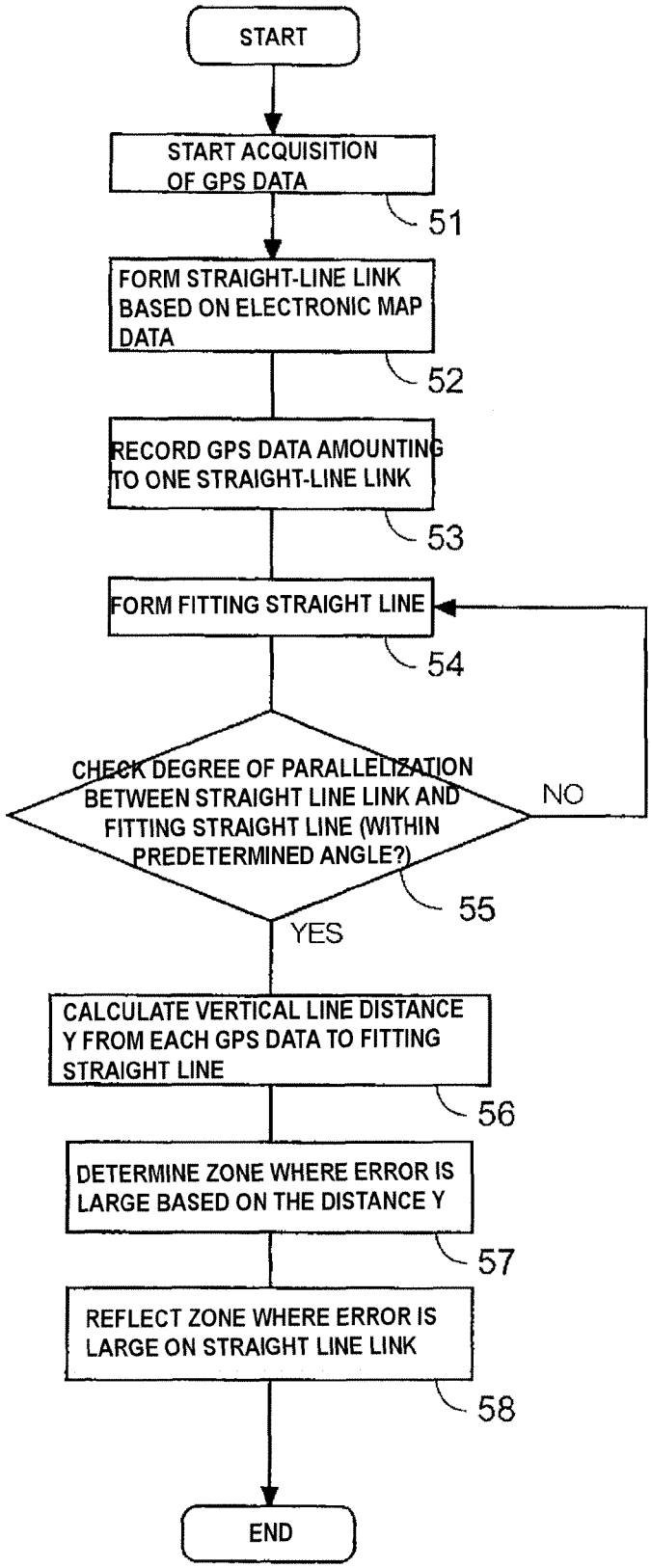
FIG. 4: A flowchart showing steps of determining error area.

In the determination of the error level by the error level determination part 13, as shown in a flowchart in FIG. 4, firstly, the vehicle information grasping part 10 acquires GPS coordinates and azimuth information from the GPS receiver 4 (step 51). The acquisition of the GPS coordinates and azimuth information is performed for every system time (0.5 seconds, for example), positions of nodes arranged adjacent to each other on a map are detected from the acquired data, and a straight-line link A is formed (step 52). That is, as shown in FIG. 3, the node O in the area where vehicle positional data (star mark) is plotted and the auxiliary node P are detected, and the straight-line link A is formed by connecting the neighboring nodes (the auxiliary node also considered as a node) by a straight line.

Subsequently, GPS data amounting to one straight-line link is recorded as vehicle positional data (data corresponding to the plurality of star marks in FIG. 5) (step 53).

A fitting straight line (approximated straight line) B is formed by the plurality of vehicle positional data (star marks) (step 54). The fitting straight line B is formed by calculating a straight line by carrying out the approximation of least squares based on a data row of vehicle positional data (star marks).

Next, the degree of parallelization between the straight line link A and the fitting straight line B is checked, and it is determined whether or not an angle made by the straight line link A and the fitting straight line B is within a predetermined angle (step 55).

When the angle is not within the predetermined angle, the fitting straight line is formed again (step 54).

In other words, a straight line is calculated by carrying out the approximation of least squares based on a data row of vehicle positional data (star marks), and the inclination of the straight line and the inclination of the link are compared to each other. When the difference between these inclinations exceeds the tolerance, the data row is selected again so as to form the fitting straight line B again. In this case, the fitting straight line B is formed again by deleting one oldest vehicle positional data (GPS data).

When the degree of parallelization of the fitting straight line B is within a predetermined angle (step 55), a vertical line distance Y from each GPS data and the fitting straight line B is calculated (step 56).

The determination of a zone where an error is large is performed based on the distance Y (step 57). In the determination of the zone where the error is large, when the error is larger than a certain value (for example, an average value of the zone), the zone where the data is present becomes a zone where the error is large. This determination is classified into "large error level", "intermediate error level", "small error level" and "no error level" depending on a value of the distance Y.

The information on the error map (see FIG. 2) of the error occurrence area memory part 92 (the error occurrence area memory part 16) is updated by reflecting zones where the error occurs ("large error level", "intermediate error level", "small error level") on the straight line link A (step 58).

Figure 6:
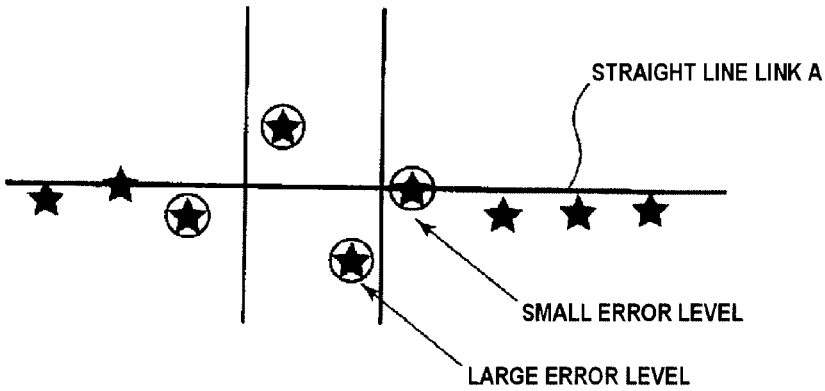
FIG. 6: A view for explaining zoning of areas depending on a size of an error with respect to vehicle positional data.

The direction of error area along the straight line link A is zoned at a middle point where the error level differs. For example, as shown in FIG. 6, when vehicle positional data (circular star marks) which differ in the occurred error with respect to the straight line link A are present continuously, an intermediate position between the vehicle positional data where the error level is large and the vehicle positional data where the error level is small (indicated by a longitudinal line in FIG. 6) becomes a border of the error areas.

Further, a lateral width of the error area is set equal to an error amount (distance Y) or is set to the error amount+one-side width of the road.

Figure 5:
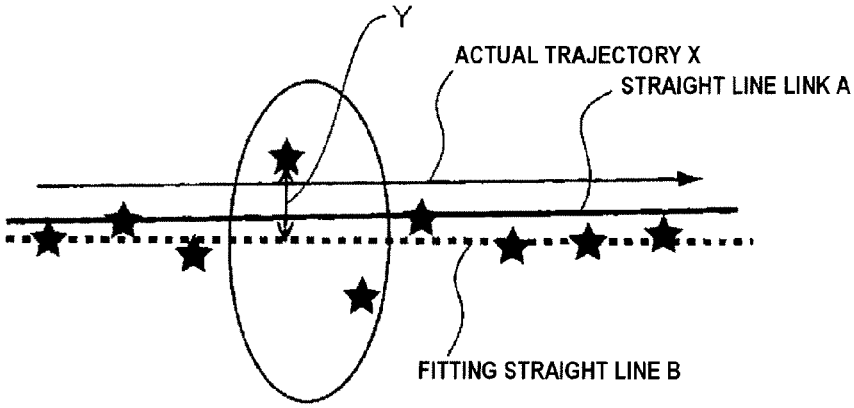
FIG. 5: A view showing the relationship between vehicle positional data and a straight line link and a fitting straight line.

In the above-mentioned example, with respect to the steps of determining the error level by the error level determination part 13, as shown in FIG. 5, the steps are executed by determining only the error in the lateral direction. However, as shown in FIG. 7, the determination may be performed by taking an error in the longitudinal direction (FIG. 7(*b*)) into consideration with respect to the error in the lateral direction (FIG. 7(*a*)).

Figure 7:
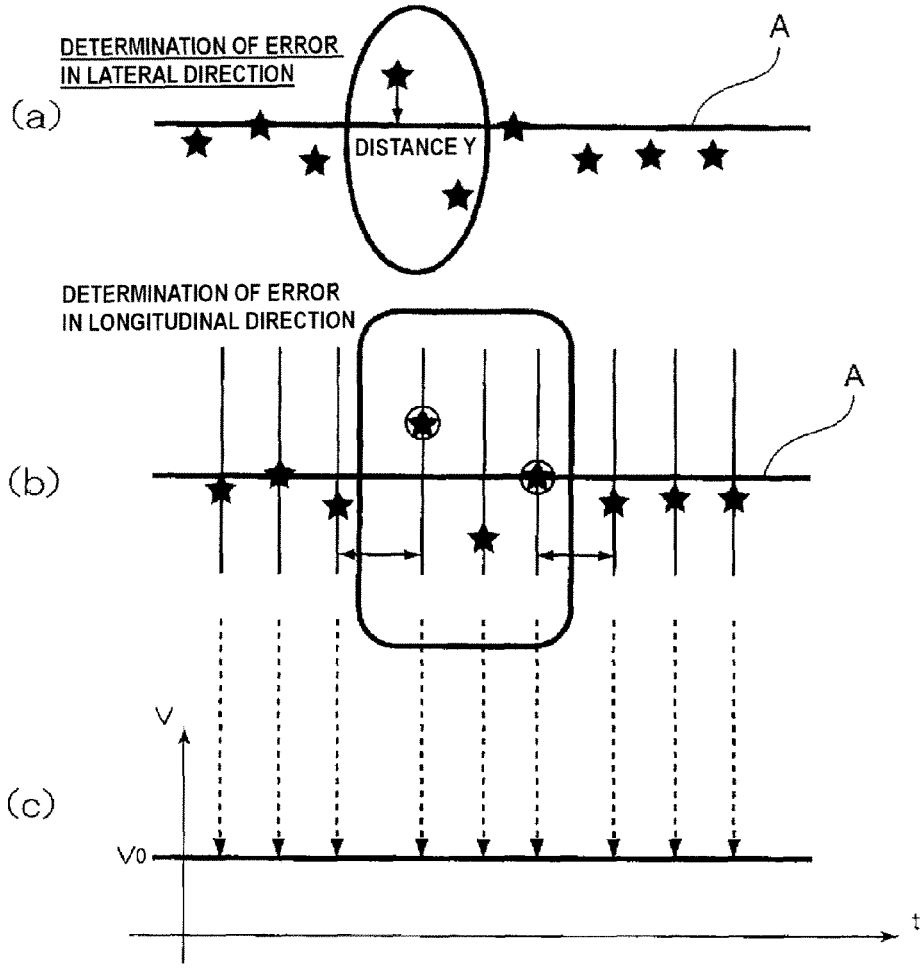
FIG. 7: An explanatory view for considering the error in the longitudinal direction with respect to vehicle positional data, wherein (a) is a view showing the relationship between vehicle positional data and a straight line link in the lateral direction, (b) is a view showing the relationship between vehicle positional data and a straight line link in the longitudinal direction, and (c) is a graph showing a vehicle speed.

In the vehicle positional data (GPS data) amounting to 1 straight line link, when there is a zone where a speed is an approximately fixed value of V0 as shown in FIG. 7(*c*), plotted positions of the vehicle positional data in FIG. 7(*b*) are expected to be positioned at equal intervals with respect to the advancing direction of the straight line link A. When the plotted positions of the vehicle positional data are not positioned at equal intervals, it is thought that an error occurs in the longitudinal direction. In FIG. 7, with respect to data at two places indicated by a circular star mark, intervals in the advancing direction are not equal intervals although the speed is approximately fixed and hence, it is determined that an error in the longitudinal direction occurs. A part surrounded by a quadrilateral in FIG. 7(*b*) indicates an area where an error in the longitudinal direction is expected to be large.

Figure 8:
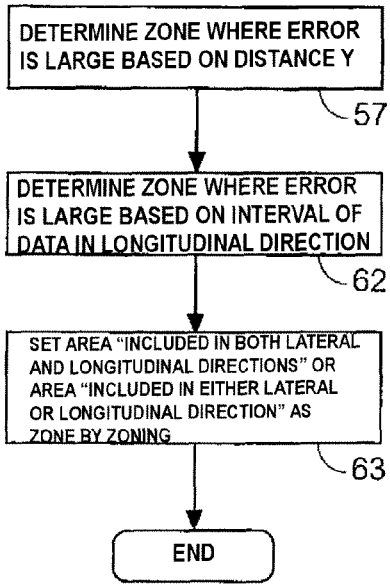
FIG. 8: A flowchart showing steps of determining an error area applied when the error in the longitudinal direction is taken into consideration.

That is, following the step 57 "determine zone where error is large based on distance Y" in the flowchart shown in FIG. 4, as shown in FIG. 8, the determination of a zone where an error is large is performed based on an interval of data in the longitudinal direction (step 61), and an area "included in both lateral and longitudinal directions" or an area "included in either in the lateral direction or in the longitudinal direction" is set as a zone by division (step 62).

Further, to enhance accuracy in setting the error occurrence area, in forming the fitting straight line in the flowchart shown in FIG. 4 (step 54), data obtained by a gyro sensor may be used. With respect to a two-wheeled vehicle, different from a four-wheeled vehicle, there may be a case where the vehicle travels by making use of a full road width (for example, crossing a road at an oblique angle) thus giving rise to a possibility that a trajectory of the vehicle and a straight line link set on a road differ from each other in inclination. In such a case, a change in azimuth, that is, the inclination of a traveling trajectory is calculated by a gyro sensor mounted on the vehicle, the straight line link is corrected, and the corrected straight line link and a fitting straight line are compared to each other.

Figure 9:
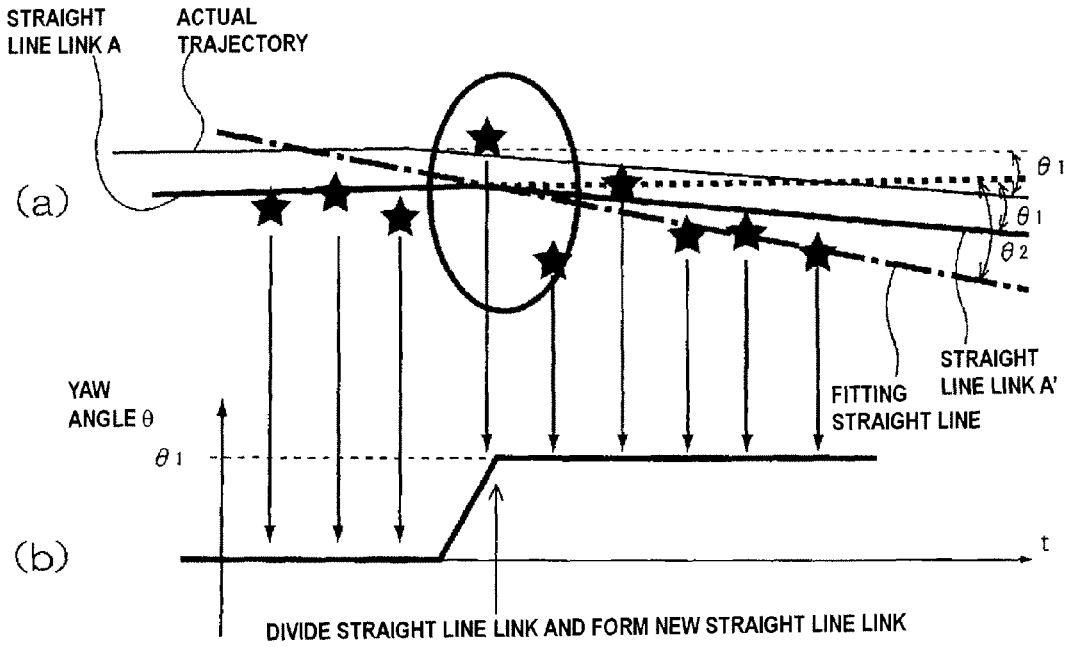
FIG. 9: An explanatory view when a fitting straight line is corrected using a gyro sensor, wherein (a) is a view showing the relationship between vehicle positional data and a straight line link and the relationship between a corrected straight line link and a fitting straight line, and (b) is a graph showing a change of a yaw angle θ1.

In other words, as shown in FIG. 9, when an actual trajectory of the vehicle (two-wheeled vehicle) is changed within the straight line link, a yaw angle θ (azimuth angle) of the vehicle is calculated by integrating values of a yaw rate gyro sensor (yaw angular velocities) (FIG. 9(*b*)) and a straight line link A' obtained by adding an angle change amount θ1 to the straight line link A is formed (FIG. 9(*a*)). In step 55 in the flowchart shown in FIG. 4, the degree of parallelization between the straight line link A' and a fitting straight line are compared to each other. That is, assuming an angle of the fitting straight line with respect to the straight line link A as θ2, when an absolute value of (θ1-θ2) is smaller than a predetermined value α, it is determined that the fitting is performed.

Figure 10:
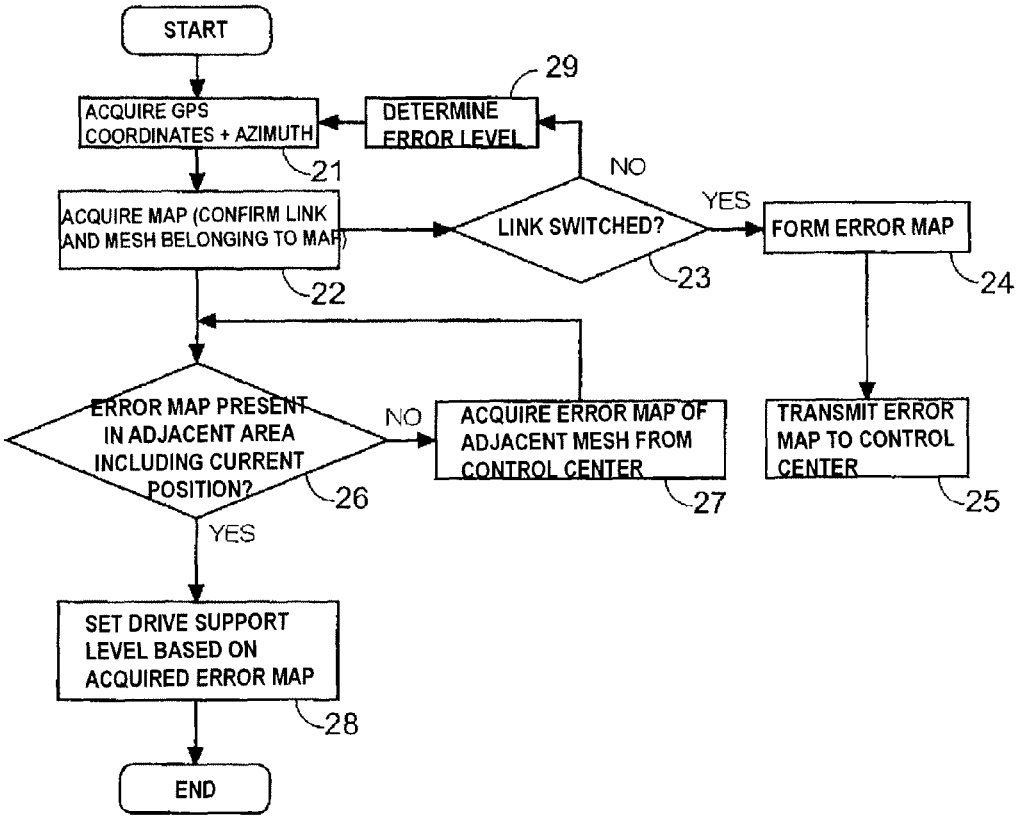
FIG. 10: A flowchart showing steps of setting a drive support level according to the embodiment of the present invention.

Next, steps of processing for setting the drive support level by the drive support level determination part 14 of the drive support device 1 which is provided with electronic map data in the control center and the external memory device 7 are explained in conjunction with a flowchart shown in FIG. 10.

The vehicle information grasping part 10 acquires GPS coordinates and azimuth information from the GPS receiver 4 (step 21). The acquisition of the GPS coordinates and azimuth information is performed for every system time (0.5 seconds, for example).

A mesh corresponding to GPS coordinates acquired from the electronic map data in the external memory device 7 is acquired, and an adjacent node and an adjacent link are selected (step 22).

It is determined whether or not the straight line link is switched (step 23), and the determination of the error level of the current link is performed until the current link is switched to a next link (step 29). When the current link is switched to the next link, the formation of the error map corresponding to the immediate preceding link is completed (step 24), and the error map or the error level information is transmitted to the control center 9 (step 25).

On the other hand, it is determined whether or not the error map is present in the adjacent area including the current position (step 26). When the error map is not present in the adjacent area, the drive support device 1 acquires the error map of the adjacent mesh from the control center 9 (step 27).

The level of the drive support is set based on the acquired error map (step 28). That is, when the position of the own vehicle in the error map (FIG. 2) is in the area at the large error level or at the intermediate error level, the drive support device 1 inhibits the offer of the drive support information at least at the stage (C) which instructs an action on the own vehicle.

In this case, the error maps which the own vehicle and another vehicle form respectively are shared in common so that the accuracy of the error map is enhanced.

Figure 11:
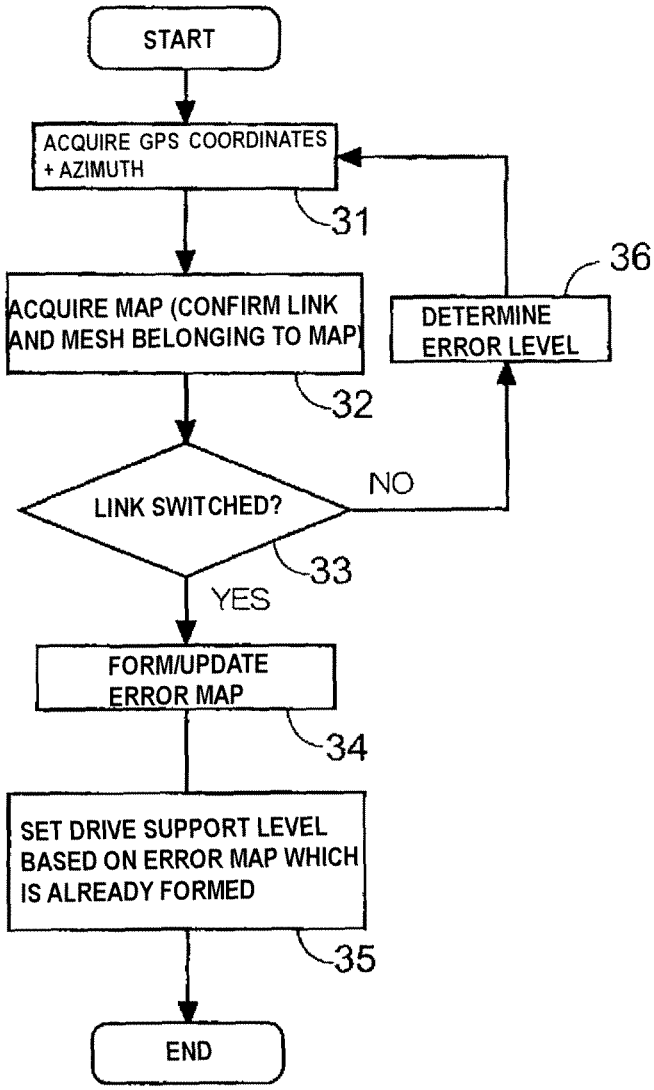
FIG. 11: A flowchart showing steps of setting a drive support level according to another embodiment of the present invention.

Next, steps of processing for setting the drive support level by the drive support device 1 when the control center 9 is not present although the external memory device 7 is provided with the electronic map data are explained in conjunction with a flowchart shown in FIG. 11.

The vehicle information grasping part 10 acquires GPS coordinates and azimuth information from the GPS receiver 4 (step 31). The acquisition of the GPS coordinates and azimuth information is performed for every system time (0.5 seconds, for example).

A mesh corresponding to GPS coordinates acquired from the electronic map data in the external memory device 7 is acquired, and an adjacent node and an adjacent link are selected (step 32).

It is determined whether or not the straight line link is switched (step 33), and the determination of the error level of the current link is performed until the current link is switched to a next link (step 36). When the current link is switched to the next link, the formation of the error map corresponding to the immediate preceding link is completed so that the error map is updated (step 34).

On the other hand, the level of the drive support is set based on the error map which is already formed (step 35).

In this embodiment, the drive support level is set using the error map which only the own vehicle forms.

Figure 12:
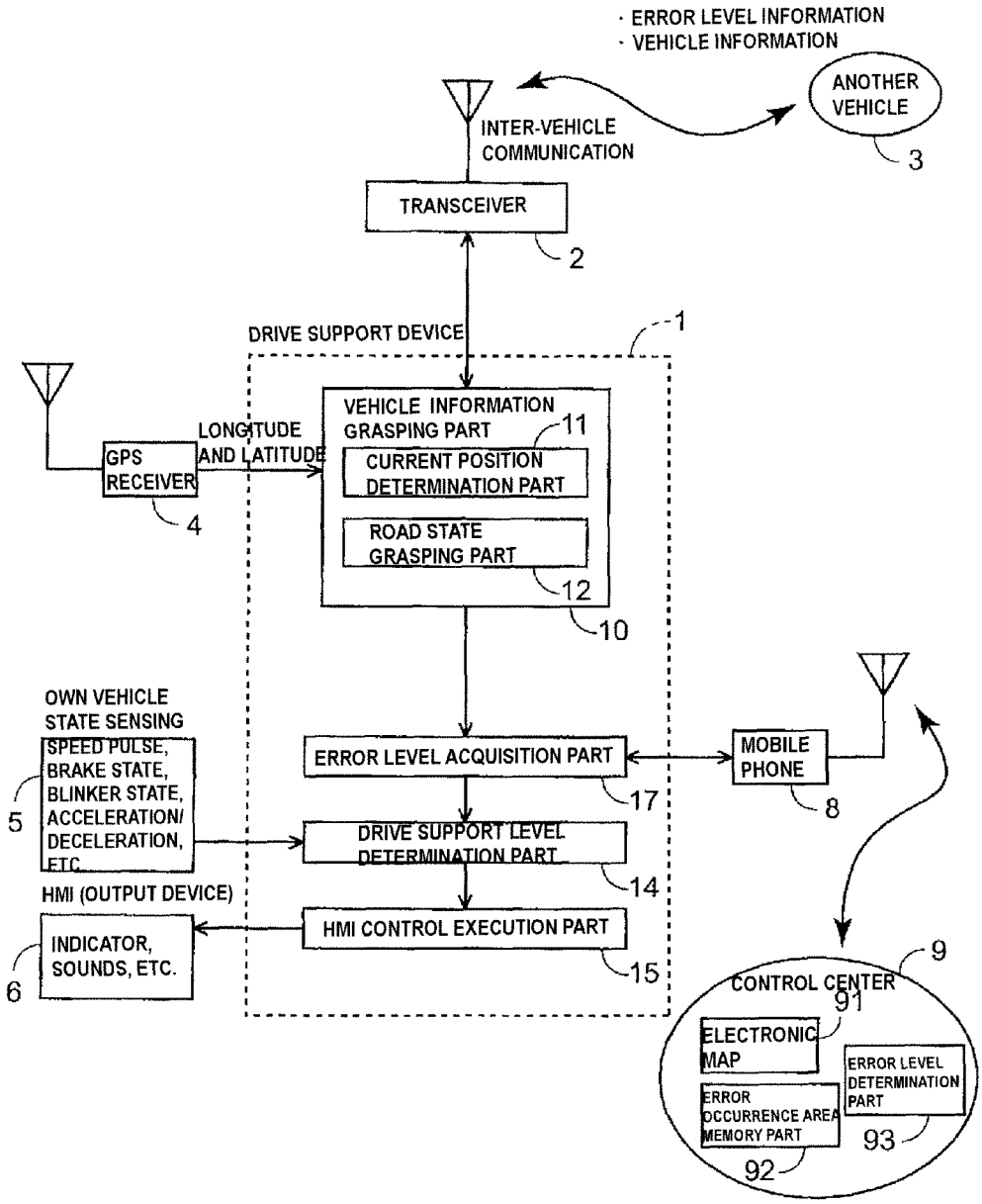
FIG. 12: A block diagram showing another embodiment of a drive support system according to the present invention.

FIG. 12 shows another example of the drive support system, wherein part having the same constitution as parts shown in FIG. 1 are given same symbols.

This example is directed to a type of drive support system of a vehicle which is not provided with an external memory device 7. In this case, information on map can be acquired from an electronic map 91 controlled by a control center 9.

Further, an error occurrence area memory part and an error level determination part 93 are also arranged on a control center 9 side, while an error level acquisition part 17 is arranged on a drive support device 1 side in place of the error level determination part 13 shown in FIG. 1. The error level acquisition part 17 is provided for acquiring error level information on a position of the own vehicle on a map from the electronic map 91 of the control center 9 and the error level determination part 93 through communication via a mobile phone 8.

Figure 13:
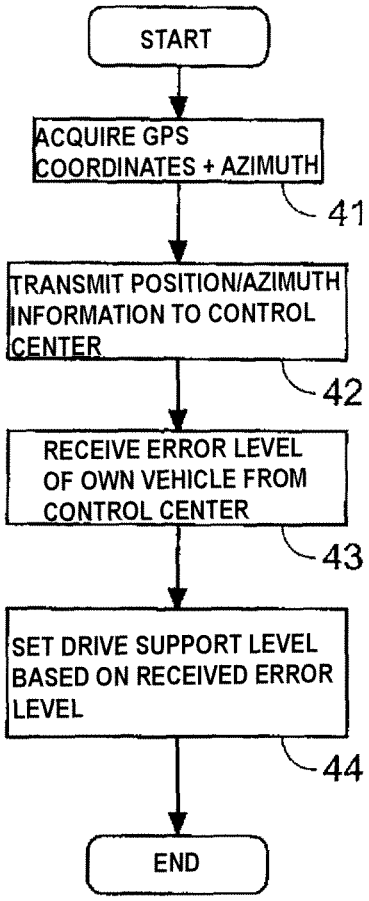
FIG. 13: A flowchart showing steps of setting a drive support level according to another embodiment of the present invention.

Steps of processing for setting the drive support level by the drive support device 1 is explained in conjunction with a flowchart shown in FIG. 13.

A vehicle information grasping part 10 acquires GPS coordinates and azimuth information from a GPS receiver 4 (step 41). The acquisition of the GPS coordinates and azimuth information is performed for every system time (0.5 seconds, for example).

The drive support device 1 transmits position/azimuth information on the own vehicle to the control center 9 for every system time (0.5 seconds, for example) (step 42).

The drive support device 1 receives an error level with respect to the position of the own vehicle from the control center 9 (step 43).

The drive support device 1 sets a drive support level based on the received error level (step 44).

According to this embodiment, the centralized control of the error information can be performed on a control center 9 side.

Figure 14:
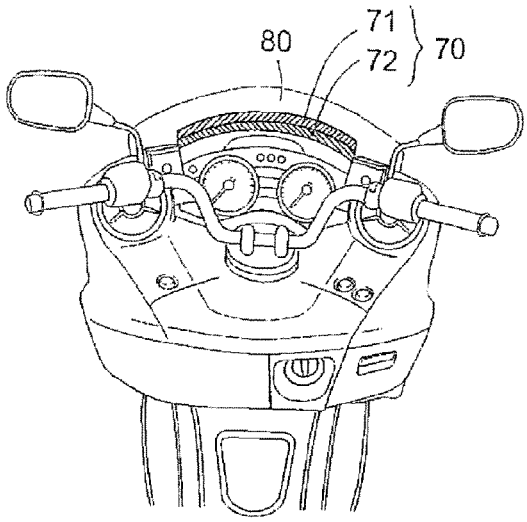
FIGS. 14(*a*) to (*c*) are constitutional explanatory views showing examples of a display device mounted on an inner lower portion of a front screen of a two-wheeled vehicle.
Figure 14:
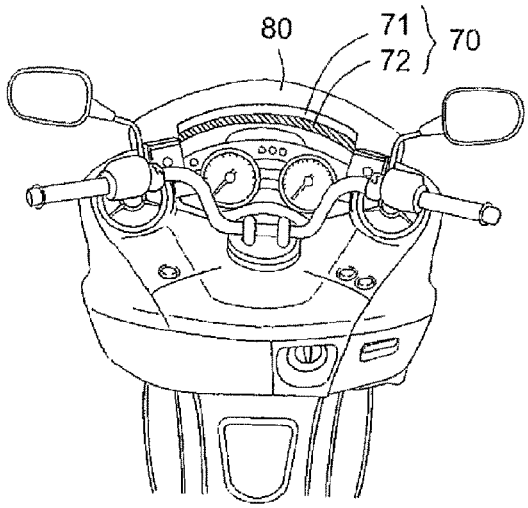
Figure 14:
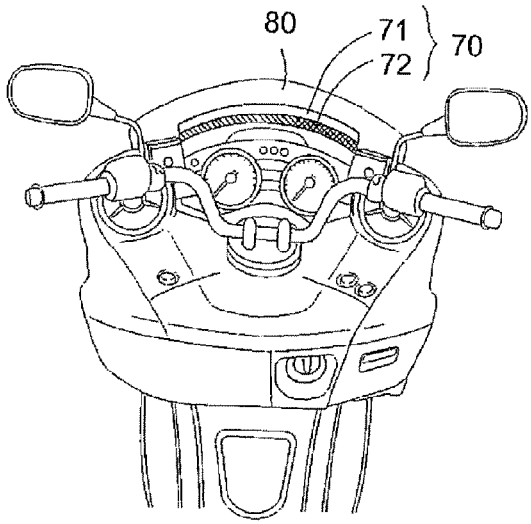

Next, a specific example of an output device 6 is explained in conjunction with FIG. 14.

The output device 6 can be constituted of a display device 70 arranged inside a front screen 80 of a two-wheeled vehicle, and the display device 70 can be constituted of an upper display part 71 and a lower display part 72 which are elongated in the lateral direction. Each display part is constituted of a plurality of LEDs arranged in an array, and is configured to perform a display in plural colors. The upper display part 71 can be configured to be turned on when "The own vehicle is positioned in an area with a large error". The lower display part 72 is configured to display information on another vehicle offered through the inter-vehicle communication.

For example, when the upper display part 71 is lit in green (indicated by a hatched portion), it is understood that the own vehicle is positioned in the area with the large error, and it is also understood that normal information with respect to another vehicle information is not offered (FIG. 14(*a*)). In this case, out of the drive supports relating to "offer of information", "invitation of attention" and "alarm", at least the drive support relating to "alarm" is not performed (the offer of information on another vehicle being limited).

When the lower display part 72 is lit in blue (indicated by a hatched portion), this means information that another vehicle is present within the communication area as "offer of information" (FIG. 14(*a*)(b)).

When the whole lower display part 72 is lit in blue and only a right side portion of the lower display part 72 is lit in different color (red, amber or the like) (indicated by a meshed portion), this means the drive support that another vehicle is approaching from a right side as "invitation of attention" (FIG. 14(*c*)).

That is, FIG. 14(*a*) shows that the own vehicle is positioned within the area with large error level and another vehicle is within the communication area.

Further, FIG. 14(*b*) shows that the own vehicle is positioned within the area with small error level and another vehicle is within the communication area.

FIG. 14(*c*) shows that the own vehicle is positioned within the area with small error level and another vehicle is approaching from a right side.

When the drive support relating to "alarm" is performed, an announcement instructing an action is made using a speaker for outputting sounds or the like mounted on the own vehicle.

The output device 6 in the above-mentioned drive support system is a speaker for outputting voices which is mounted on the own vehicle (vehicle), or indicators which are arranged in the inside of a meter mounted on the handle bar or are mounted on the inner lower portion of the front screen. However, the output device 6 may be a display means capable of displaying map information. In this case, map information to be displayed may be formed such that the position of the own vehicle is displayed with respect to the error map (FIG. 2) acquired from the error occurrence area memory parts 92, 16. "Large error level", "intermediate error level" and "small error level" (areas where the error becomes a predetermined value or more) are reflected on the map information as visual images. In the error map, when the error level is displayed by the visual image, a length in the widthwise direction of an area corresponding to the error level is a length obtained by adding a width of a road to a size of the error and hence, the area of the visual image is increased along with the increase of the error whereby the drive support system can easily grasp the area of which error level the own vehicle is present in.

DESCRIPTION OF REFERENCE NUMERALS AND SIGNS

1: drive support device, 2: transceiver, 3: another vehicle, 4: GPS receiver, 5: sensor, 6: output device, 7: external memory device, 8: mobile phone, 9: control center, 10: vehicle information grasping part, 11: current position determination part, 12: road state grasping part, 13: error level determination part, 14: drive support level determination part, 15: HMI control execution part, 16: error occurrence area memory part, 17: error level acquisition part, 70: display device, 71: upper display part, 72: lower display part, 91: electronic map, 92: error occurrence area memory part, 93: error level determination part, A: straight line link, B: fitting straight line (approximate straight line), O: node, P: auxiliary node

The invention claimed is:

1. A drive support system, comprising:

a drive support level determination part which is configured to elevate a degree of offer of drive support information relating to a degree of danger in a stepwise manner as an own vehicle and another vehicle approach to each other in positional relationship; and an error occurrence area memory part which is configured to store an area where an error in positional information becomes at or above a predetermined level in advance along with map information, wherein when the own vehicle is present within the area where the error in the positional information becomes at or above the predetermined level, the drive support information whose degree of offer of the drive support information relating to the degree of danger becomes at or above the predetermined value is limited, wherein the drive support system comprises a transceiver configured to offer the drive support information on travelling relating to the degree of danger of the own vehicle with respect to the another vehicle based on the positional information by carrying out transmission and reception of at least positional information between the own vehicle and the another vehicle when the another vehicle is present within a communication area of the own vehicle.

2. The drive support system according to claim 1, wherein the degree of offer of the drive support information determined by the drive support level determination part includes:

a first stage where the drive support system informs the presence of another vehicle within the communication area, and a second stage where the drive support system informs a direction along which another vehicle having a near positional relationship with the own vehicle is present, wherein the offer of the drive support information at the second stage is inhibited when the own vehicle is present in the area where the error of the positional information is at or above the predetermined level.

3. The drive support system according to claim 1, wherein the drive support level determination part includes an error level determination part which is configured to determine whether or not the error of the positional information is at or above the predetermined level, and when the determination area where the error level determination part determines that the error is at or above the predetermined level is an area which is not stored in the error occurrence area memory part, the determination area is newly stored in the error occurrence area memory part.

4. The drive support system according to claim 3, wherein the error level determination part is configured to store positional information acquired at predetermined intervals and to calculate an approximate straight line based on the stored positional information, and the determination of the error in the positional information is performed under a condition where the positional information is away from the approximate straight line by a predetermined distance or more.

5. The drive support system according to claim 4, wherein the map information includes nodes which are configured to be in conformity with a shape of a road and a straight line link which connects the nodes, and the error level determination part is configured to determine an error level when a degree of parallelization between the straight line link and the approximate straight line is within a predetermined value.

6. The drive support system according to claim 4, wherein the own vehicle includes a yaw rate gyro sensor, and when a trajectory of the own vehicle is changed within the approximate straight line, a new approximate straight line is formed by adding a change amount of a yaw angle obtained by integrating a value of the yaw rate gyro sensor to an approximate straight line calculated by the error level determination part, and the determination of an error in the positional information is performed based on the new approximate straight line.

7. The drive support system according to claim 1, wherein the drive support system includes an output means for outputting the drive support information and, when the own vehicle is present within the area where the error in the positional information is at or above a predetermined level, information indicative of a presence of the own vehicle in the area is outputted to the output means.

8. The drive support system according to claim 7, wherein the output means comprises a display means for displaying map information, and wherein the error occurrence area memory part is configured to reflect an area where an error is at or above the predetermined level on the map information as a visual image, and is configured to increase an area of the visual image along with the increase of the error.

9. The drive support system according to claim 8, wherein a length of the area of the visual image in a widthwise direction is obtained by adding a width of a road to a size of the error.

10. The drive support system according to claim 1, wherein the error occurrence area memory part is configured to be subjected to a centralized control by a control center, and wherein the error occurrence area memory part is configured to collect, update and distribute error information from the own vehicle and the another vehicle.

11. A method comprising:

elevating, via a drive support level determination part, a degree of offer of drive support information relating to a degree of danger in a stepwise manner as an own vehicle and another vehicle approach each other in positional relationship;

storing, via an error occurrence area memory part, an area where an error in positional information becomes at or above a predetermined level in advance along with map information; and offering drive support information on traveling related to the degree of danger of the own vehicle with respect to the another vehicle based on the positional information by carrying out, via a transceiver, transmission and reception of at least the positional information between the own vehicle and the another vehicle when the another vehicle is present within a communication area of the own vehicle, wherein when the own vehicle is present within the area where the error in the positional information becomes at or above the predetermined level, the drive support information whose degree of offer of the drive support information relating to the degree of danger becomes at or above the predetermined value is limited.

12. The method according to claim 11, wherein the degree of offer of the drive support information determined by the drive support level determination part includes: a first stage where the drive support system is configured to inform the presence of another vehicle within the communication area, and a second stage where the drive support system is configured to inform a direction along which another vehicle having a near positional relationship with the own vehicle is present, wherein the offer of the drive support information at the second stage is inhibited when the own vehicle is present in the area where the error of the positional information is at or above the predetermined level.

13. The method according to claim 11, wherein the drive support level determination part includes an error level determination part configured to determine whether or not the error of the positional information is at or above the predetermined level, and when the determination area where the error level determination part is configured to determine that the error is at or above the predetermined level is an area which is not stored in the error occurrence area memory part, the determination area is newly stored in the error occurrence area memory part.

14. The method according to claim 13, wherein the error level determination part is configured to store positional information acquired at predetermined intervals and for calculating an approximate straight line based on the stored positional information, and the determination of the error in the positional information is performed under a condition where the positional information is away from the approximate straight line by a predetermined distance or more.

15. The method according to claim 14, wherein the map information includes nodes which are in conformity with a shape of a road and a straight line link which connects the nodes, and wherein the error level determination part is configured to determine an error level when a degree of parallelization between the straight line link and the approximate straight line is within a predetermined value.

16. The method according to claim 14, wherein the own vehicle includes a yaw rate gyro sensor configured to sense a yaw rate of the vehicle, wherein when a trajectory of the own vehicle is changed within the approximate straight line, a new approximate straight line is formed by adding a change amount of a yaw angle obtained by integrating a value of the yaw rate gyro sensor to an approximate straight line calculated by the error level determination part, and the determination of an error in the positional information is performed based on the new approximate straight line.

17. The method according to claim 11, wherein the drive support system includes an output device configured to output the drive support information and, when the own vehicle is present within the area where the error in the positional information is at or above a predetermined level, information indicative of a presence of the own vehicle in the area is outputted to the output device.

18. The method according to claim 17, wherein the output device comprises a display configured to display map information, and wherein the error occurrence area memory part is configured to reflect an area where an error is at or above the predetermined level on the map information as a visual image, and to increase an area of the visual image along with the increase of the error.

19. The method according to claim 18, wherein a length of the area of the visual image in a widthwise direction is obtained by adding a width of a road to a size of the error.

20. The method according to claim 11, wherein the error occurrence area memory part is subjected to centralized control by a control center, and wherein the error occurrence area memory part is configured to collect, update, and distribute error information from the own vehicle and the another vehicle.

* * * * *